US008065960B2

(12) United States Patent
Grosch et al.

(10) Patent No.: US 8,065,960 B2
(45) Date of Patent: Nov. 29, 2011

(54) HAND GRENADE

(75) Inventors: Hermann Grosch, Nienhagen (DE); Michael Günther, Meerbusch (DE)

(73) Assignee: Rheinmetall Landsysteme GmbH, Kiel (DE)

( * ) Notice: Subject to any disclaimer, the term of this patent is extended or adjusted under 35 U.S.C. 154(b) by 327 days.

(21) Appl. No.: 11/997,291

(22) PCT Filed: Jul. 26, 2006

(86) PCT No.: PCT/EP2006/007377

§ 371 (c)(1),
(2), (4) Date: Sep. 4, 2009

(87) PCT Pub. No.: WO2007/014684

PCT Pub. Date: Feb. 8, 2007

(65) Prior Publication Data

US 2010/0043663 A1 Feb. 25, 2010

(30) Foreign Application Priority Data

Jul. 29, 2005 (DE) ..... 10 2005 035 580

(51) Int. Cl.
*F42B 27/00* (2006.01)

(52) U.S. Cl. ..... 102/487; 102/482; 102/427; 102/215

(58) Field of Classification Search ..... 102/482, 102/487, 488, 424, 427, 215
See application file for complete search history.

(56) References Cited

U.S. PATENT DOCUMENTS

| | | | | |
|---|---|---|---|---|
| 3,712,218 | A * | 1/1973 | Fay | 102/216 |
| 5,136,949 | A * | 8/1992 | Grosch | 102/215 |
| 5,246,372 | A * | 9/1993 | Campagnuolo et al. | 434/11 |
| 6,761,117 | B1 * | 7/2004 | Benz | 102/482 |
| 7,373,849 | B2 * | 5/2008 | Lloyd et al. | 73/865.8 |
| 2006/0230972 | A1 * | 10/2006 | Ouliarin | 102/487 |

FOREIGN PATENT DOCUMENTS

| | | |
|---|---|---|
| DE | 1 806 214 | 7/1969 |
| DE | 4027150 C1 | 1/1992 |
| DE | 199 45 790 A1 | 5/2000 |
| FR | 2 563 001 A1 | 10/1985 |

OTHER PUBLICATIONS

International Search Report issued in corresponding application No. PCT/EP2006/007377, completed Nov. 7, 2006 and mailed Nov. 14, 2006.

* cited by examiner

*Primary Examiner* — James Bergin
(74) *Attorney, Agent, or Firm* — Griffin & Szipl, P.C.

(57) ABSTRACT

The invention relates to a hand grenade (1) with an active body (3) containing an active charge (2), and with an ignition device (4) that acts on a detonator (12) to ignite the active charge (2). In order to achieve this feature, after the hand grenade (1) has been thrown the ignition can be triggered without delay if the tactical situation requires it, and no danger arises for the shooter if the hand grenade (1) with the safety device released is dropped accidentally. The invention pertains to an electronic ignition system composed of an ignition trigger (6) and a fuze (8) used as the ignition device (4), whereby the ignition trigger (6) remains with the shooter when the hand grenade (1) is thrown and the hand grenade (1) can be ignited by wireless only when the shooter activates an ignition trigger element (11) of the ignition trigger (6).

16 Claims, 2 Drawing Sheets

HAND GRENADE

This is a National Phase Application in the United States of International Patent Application No. PCT/EP2006/007377 filed Jul. 26, 2006, which claims priority on German Patent Application No. 10 2005 035 580.3, filed Jul. 29, 2005. The entire disclosures of the above patent applications are hereby incorporated by reference.

FIELD OF THE INVENTION

The invention relates to a hand grenade with an active body containing an active charge, and with an ignition device that acts on a detonator to ignite the active charge.

BACKGROUND OF THE INVENTION

Known hand grenades are equipped as a rule with a mechanical ignition system with a set ignition delay time. If the hand grenade is released from the hand after a pin is drawn, the active charge is initiated after about 4 seconds. A variation of this time by the shooter of the hand grenade is not possible.

A predetermined ignition delay time of this type restricts the use of the hand grenades i.a. whenever the tactical situation requires a precise triggering of the hand grenade in accordance with the situation (e.g. in house-to-house fighting). A further disadvantage of the set ignition delay time is the possibility for the opponent to throw back a thrown hand grenade or to take cover.

Furthermore a hand grenade whose safety has been released and that has been released from the hand cannot be secured again, so that the user of the hand grenade is particularly endangered if the hand grenade with a pulled pin falls from his hand and he does not succeed in bringing it out of the danger zone within 4 seconds.

The object of the invention is to disclose a hand grenade in which the ignition is triggered without delay after it has been thrown into an appropriate target area, if the tactical situation requires this. Moreover if the hand grenade is accidentally dropped after the safety is released, no endangerment of the shooter should arise.

SUMMARY OF THE INVENTION

This object is achieved according to the invention through the features of a hand grenade with an active body (3) containing an active charge (2) and with an ignition device (4) that acts on a detonator (12) to ignite the active charge (2), wherein: (a) the ignition device (4) is an electronic ignition system composed of an ignition trigger (6) and a fuze (8); (b) the fuze (8) including a first ignition circuit (23) is arranged in the active body (3) and the ignition trigger (6) is arranged in a control part (5) that can be removed from the active body (3) before the hand grenade (1) is thrown and that can remain with the user of the hand grenade (1); and the ignition trigger (6) includes a transmitting device (9) that operates by wireless and the fuze (8) includes a receiving device (10) that interacts with the transmitting device (9), so that after the hand grenade (1) has been thrown into a target area, a carrier signal coded with an ignition code is emitted by the transmitting device (9) by means of an ignition trigger element (11) of the ignition trigger (6), which carrier signal is received by the receiving device (10) of the fuze (8), decoded, and utilized to activate the detonator (12) of the hand grenade (1).

In accordance with a second embodiment of the present invention, the first embodiment is further characterized in that the ignition device (4) includes a code generator (13) that with the aid of a random generator produces an ignition code immediately before or at the detaching of the control part (5), which ignition code is stored both in a code memory (14) of the ignition trigger (6) and in a code memory (15) of the fuze (8) and upon activation of the transmitting device (9), serves to code the carrier signal produced by the transmitting device (9).

In accordance with a third embodiment of the present invention, a hand grenade according to the first or second embodiment is provided wherein the ignition device (4) includes a first switching element (16) that at the detachment of the control part (5) from the active body (3) activates a power supply unit (17) for operating the components of the ignition device (4).

In accordance with a fourth embodiment of the invention, a hand grenade according to any one of the first three embodiments of the invention is further characterized in that the control part (5) containing the ignition trigger (6), and the fuze (8), form a connected unit that is secured by a pin (7) and is not connected to the active body (3) until during the preparation for use of the hand grenade (1), and that a separation of the control part (5) and the fuze (8) situated in the active body (3) is only possible after the pin (7) has been pulled.

In accordance with a fifth embodiment of the present invention, a hand grenade according to any one of the first through fourth embodiments is modified so that a safety element (19) is arranged in the control part (5), which safety element (19) secures the ignition trigger element (11) in a starting position until the control part (5) is detached from the fuze (8).

In accordance with a sixth embodiment of the invention, and grenade according to the fourth or fifth embodiments is further modified so that a curved safety piece (21) pre-tensioned by a spring (20) and able to be secured by the pin (7) is arranged on the active body (3), and that the fuze (8) includes a second switching element (22) that interacts with the curved safety piece (21) in such a way that after removal of the pin (7) and the control part (5), when the active body (3) is thrown the curved safety piece (21) opens and the second switching element (22) closes, so that the receiving device (10) is activated, the first ignition circuit (23) is charged, and a first time-delay circuit (24) is initiated.

In accordance with a seventh embodiment of the invention, a hand grenade according to one of the previous embodiments one through six is characterized in that the fuze (8) includes a compressed gas generator (26) that in the absence of the receipt of a coded ignition signal within a period of time that can be determined by a second time-delay circuit (27), can be activated by a second ignition circuit (26) in such a way that the gas pressure produced is sufficient to expel the fuze (8) from the active body (3).

In accordance with an eighth embodiment of the invention, a hand grenade according to the seventh embodiment is modified so that the second ignition circuit (28) is likewise activated by the second switching element (22).

In accordance with a ninth embodiment of the invention, a hand grenade according to the embodiments one to eight is modified so that the control part (5) is a head part of the hand grenade (1) that can be connected to the fuze (8) via a screw connection.

In accordance with a tenth embodiment of the present invention, a hand grenade according to one of embodiments one to nine is characterized in that the carrier signals for transmitting the ignition code are high-frequency, light-, or sound signals.

In accordance with an eleventh embodiment of the present invention, a hand grenade according to one of the first through tenth embodiments is characterized in that the control part (5) is connected to the fuze (8) via a force-closed connection (25) and/or positive-engagement connection in such a way that even when the pin (7) has been pulled, the curved safety piece (21) cannot be swiveled into a released position, and it is only possible to release the curved safety piece (21) when the control part (5) is removed from the fuze (8).

Thus, the various embodiments two through eleven pertain to further particularly advantageous embodiments of the invention.

The invention is based essentially on the concept of using, as the ignition device, an electronic ignition system composed of an ignition trigger and a fuze, whereby the ignition trigger remains with the shooter as the hand grenade is thrown and the hand grenade can be ignited by wireless only when the shooter activates the ignition trigger.

To this end the ignition trigger includes a transmitting device that operates by wireless, and the fuze arranged in the active body includes a receiving device that interacts with the transmitting device, so that after the hand grenade has been thrown into a target area, a carrier signal coded with an ignition code is emitted by the transmitting device by means of an ignition trigger element of the ignition trigger (e.g. a pushbutton), which carrier signal is received by the receiver of the fuze, decoded, and utilized to activate the detonator of the hand grenade.

In a first form of embodiment of the invention it is provided that the ignition device includes a code generator that with the aid of a random generator produces an ignition code immediately before or only at the detaching of the control part, which ignition code is stored both in a code memory of the ignition trigger and in a code memory of the fuze and upon activation of the transmitting device, serves to code the carrier signal produced by the transmitting device. Only this code then causes a triggering of the fuze.

Both for safety reasons and also for energy-saving reasons, it has proved to be advantageous if the ignition device includes a first switching element that activates a power supply unit for operating the components of the ignition device (e.g. of the code generator) only at the detachment of the control part from the active body.

In a further form of embodiment of the invention, in the transport state the control part containing the ignition trigger, and the fuze form a connected unit that is secured by a pin and is not connected to the active body until during the preparation for use of the hand grenade. A separation of the control part and the fuze situated in the active body is only possible thereby after the pin has been pulled.

For safety reasons it has further proved advantageous if a safety element is arranged in the control part, which safety element secures the ignition trigger element in a starting position until the control part is detached from the active body.

Furthermore it has proved expedient for safety reasons if a curved safety piece pre-tensioned by a spring and able to be secured by the pin is arranged on the active body, and that the fuze includes a second switching element that interacts with the curved safety piece in such a way that after removal of the pin and the control part, when the active body is thrown the curved safety piece opens and the second switching element closes, so that the receiver is activated, the first ignition circuit is charged, and a first time-delay circuit is initiated.

In order to prevent safety problems from developing as soon as the hand grenade is accidentally dropped with the pin pulled, it has further proved to be advantageous if the control part is connected to the fuze via a force-closed connection and/or positive-engagement connection in such a way that even when the pin has been pulled, the curved safety piece cannot be swiveled into a released position. It is only possible to release the curved safety piece when the control part has also been removed from the fuze.

In order to prevent a hand grenade that has not ignited in the target area from being activated accidentally, in a further form of embodiment of the invention it is provided that the fuze includes a compressed gas generator that in the absence of the receipt of a coded ignition signal within a period of time that can be determined by a second time-delay circuit, can be activated by a second ignition circuit in such a way that the gas pressure produced is sufficient to expel the fuze from the active part. The second ignition circuit can likewise be activated by the second switching element thereby.

The carrier signals for transmitting the ignition code can be high frequency-, light-, or sound signals.

The hand grenade according to the invention can be—depending on its type of application and task—a concussion-, fragmentation-, flash-, incendiary-, smoke-, or tear gas grenade.

BRIEF DESCRIPTION OF THE DRAWINGS

Further details and advantages of the invention are revealed by the following exemplary embodiments illustrated by figures. They show:

In FIG. 1, 1 refers to a hand grenade that contains an active body 3 containing an active charge 2 and an electronic ignition device 4 for igniting the active charge 2 and that can be connected to the active body 3 e.g. via a screw connection.

DETAILED DESCRIPTION OF THE INVENTION

Figure 1:
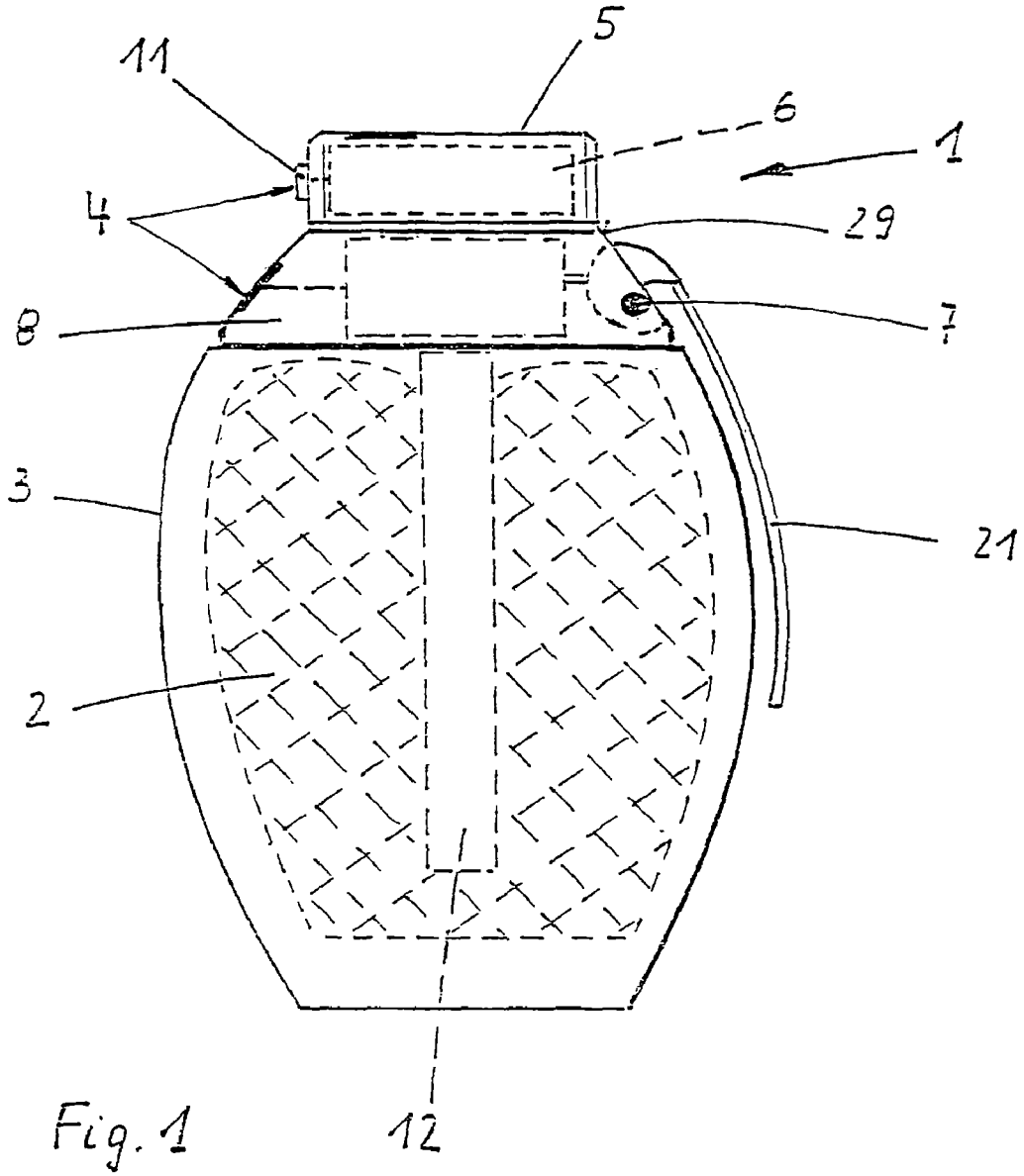
FIG. 1 the side view of a hand grenade according to the invention.

The ignition device 4 is composed essentially of an control part 5 forming the head part of the hand grenade 1 and having an electronic ignition trigger 6, and a fuze 8 secured by a pin 7 and connected to the control part 5 e.g. via a screw connection.

The ignition trigger 6 includes a high-frequency transmitting device 9 (FIG. 2) and the fuze 8 includes a receiving device 10 interacting with the transmitting device 9, so that after the hand grenade 1 has been thrown into a target area, a carrier signal coded with an ignition code is emitted by means of an ignition trigger element 11 of the ignition trigger 6 by the transmitting device 9, which carrier signal is received and decoded by the receiving device 10 of the fuze 8 and is utilized to activate a detonator 12 (FIG. 1) of the hand grenade 1.

For coding the carrier signal produced by the transmitting device 9, a code generator 13 is arranged in the fuze 8, which code generator 13 with the aid of a random generator (not shown) produces an ignition code immediately before or at the detachment of the control part 5, which ignition code is stored in a code memory 14 of the ignition trigger 6 and also in a code memory 15 of the fuze 8.

Moreover the ignition device 4 includes a first switching element 16 that when the control part 5 is detached from the active body 3, activates a power supply unit 17 to operate the components of the ignition device 4 (e.g. the code memory).

Furthermore a safety element 19 pre-tensioned by a spring 18 is provided in the control part 5, which safety element 19 secures the ignition trigger element 11 in a starting position until the control part 5 is detached from the fuze 8 and thus from the active body 3.

At the fuze 8, a curved safety piece 21 pre-tensioned by a spring 20 and likewise secured by the pin 7 is arranged, which curved safety piece 21 interacts with a second switching element 22 in such a way that after removal of the pin 7 and the control part 5, when the active body 3 is thrown the curved safety piece 21 opens and the second switching element 22 is closed, so that the receiving device 10 is activated, a first ignition circuit 23 is charged, and a first time-delay circuit 24 is initiated.

Figure 2:
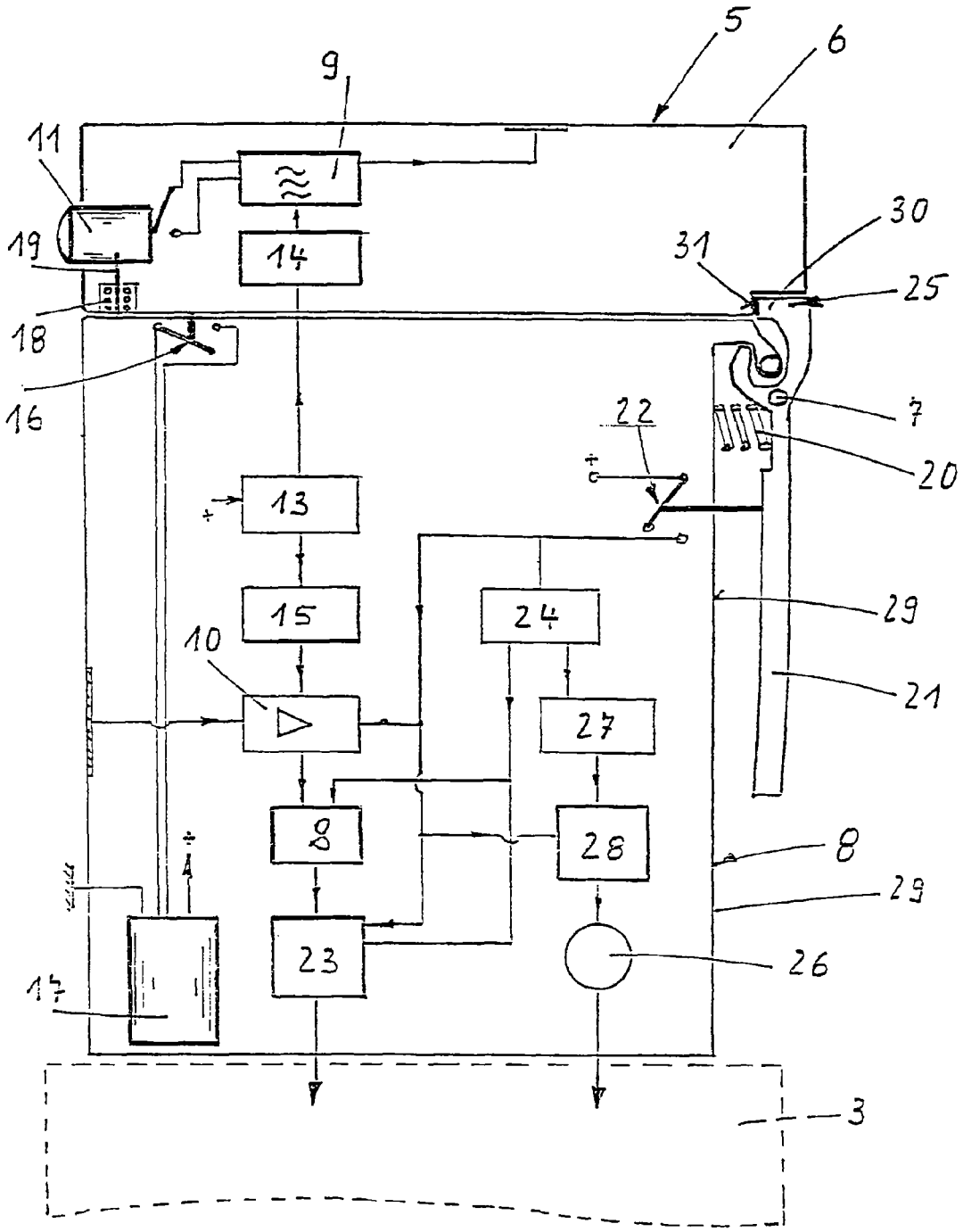
FIG. 2 a block diagram of the ignition device used in the hand grenade shown in FIG. 1.

As can be taken from FIG. 2, the control part 5 is connected to the fuze 8 via a force-closed connection 25 in such a way that the curved safety piece 21 cannot be swiveled into a released position even when the pin 7 has been pulled, and a release of the curved safety piece 21 is not possible until the control part 5 is removed from the fuze 8.

As can likewise be taken from FIG. 2, the fuze 8 moreover includes a compressed gas generator 26, which in the absence of the receipt of a coded ignition signal within a period of time that can be determined by a second time-delay circuit 27, can be activated by a second ignition circuit 28 in such a way that the gas pressure produced is sufficient to expel the fuze 8 from the active body 3.

The function-and control sequence of the hand grenade 1 according to the invention is detailed below.

In the transport state, the control part 5 and the fuze 8 of the ignition device 4 form a firmly connected unit. The pin 7 thereby secures both the control part 5 on the fuze 8 and the curved safety piece 21 on the fuze housing 29.

In the preparation for use, the ignition device 4 is then connected to the respectively selected active body 3.

During the subsequent preparation for the normal use of the hand grenade 1, the respective shooter grasps the curved safety piece 21 together with the active body 3 and pulls the pin 7. By these means the safety of the curved safety piece 21 is partially released. However, the curved safety piece 21 in this phase still remains in its position even when the curved piece is released, since an upper part 30 embodied in the shape of a hook is pressed by the spring 20 in a force-closed manner against the floor 31 of a groove-shaped recess of the control part 5.

The shooter now presses the curved safety piece 21 somewhat in the direction of the fuze housing 29 and detaches the control part 5 from the fuze 8 by a short turning movement. This causes the ignition trigger element 11 to be released by the safety element 19 and the power supply unit 17 in the fuze 8 to be activated, so that the ignition trigger code is generated by the code generator 13 and this code is then stored in the code memory 15 of the fuze 8 and in the code memory 14 of the ignition trigger 6. Moreover the curved safety piece 21 is released.

The hand grenade 1 according to the invention is now ready to throw. The active body 3 with fuze 8 is situated in the throwing hand of the shooter and the control part 5 with ignition trigger 6 is in the other hand. Then the active body 3 equipped with the fuze 8 is thrown in the direction of the target, whereby the control part 5 remains in the hand of the shooter.

During the throw of the active body 3, the curved safety piece 21 becomes free and is pivoted outwards by the spring 20 and detaches itself from the fuze 8. By these means the second switching element 22 is closed and the receiving device 10 is switched on, the two ignition circuits 23 and 28 are charged, and the first and the second time-delay circuits 24 and 27 are initiated.

After the time determined by the first time-delay circuit 24 (e.g. 800 ms) has elapsed, the fuze 8 is ready for triggering, i.e. when the ignition trigger element 11 on the control part 5 is activated, the detonator 12 is triggered directly or after a pre-settable time (e.g. 200 ms) by transmission of the ignition code by the transmitting device 9 to the receiving device 10 (the coding—and transmission method corresponds to the method described in publication DE 40 27 150 C1).

If no ignition code is received by the receiving device 10 of the fuze 8 within a certain time (e.g. 30 min) set by the second time-delay circuit 27, which time is preset structurally or can be pre-selected by the shooter, the fuze is expelled from the active body 3 with the aid of the compressed gas generator 26 and optionally the detonator 12 is triggered subsequently.

LIST OF REFERENCE NUMBERS

1 Hand grenade
2 Active charge
3 Active body
4 Ignition device
5 Control part
6 Ignition trigger
7 Pin
8 Fuze
9 (High-frequency) transmitting device
10 Receiving device
11 Ignition trigger element
12 Detonator
13 Code generator
14 Code memory
15 Code memory
16 First switching element
17 Power supply unit
18 Spring
19 Safety element
20 Spring
21 Curved safety piece
22 Second switching element
23 First ignition circuit
24 First time-delay circuit
25 Force-closed connection
26 Compressed gas generator
27 Second time-delay circuit
28 Second ignition circuit
29 Fuze housing
30 Part
31 Floor

The invention claimed is:

1. A hand grenade with an active body containing an active charge, and with an ignition device that acts on a detonator to ignite the active charge, wherein:

(a) the ignition device is an electronic ignition system comprising an ignition trigger and a fuze;

(b) the fuze includes a first ignition circuit arranged in the active body and the ignition trigger is arranged in a control part that can be removed from the active body before the hand grenade is thrown and that can remain with the user of the hand grenade;

(c) the ignition trigger includes a transmitting device that operates by wireless, and the fuze includes a receiving device that interacts with the transmitting device, so that after the hand grenade has been thrown into a target area, a carrier signal coded with an ignition code is emitted by the transmitting device by means of an ignition trigger element of the ignition trigger, wherein the carrier signal is received by the receiving device of the fuze, decoded, and utilized to activate the detonator of the hand grenade, wherein the ignition device includes a code generator that, with the aid of a random generator, produces an ignition code immediately before or at detaching of the control part, wherein the ignition code is stored both in a code memory of the ignition trigger and in a code memory of the fuze and, upon activation of the transmitting device, serves to code the carrier signal produced by the transmitting device.

2. A hand grenade according to claim 1, wherein the ignition device further includes a first switching element that at detachment of the control part from the active body activates a power supply unit for operating components of the ignition device.

3. A hand grenade according to claim 2, wherein the control part containing the ignition trigger, and the fuze, form a connected unit that is secured by a pin and is not connected to the active body until during preparation for use of the hand grenade, and that separation of the control part and the fuze situated in the active body is only possible after the pin has been pulled.

4. A hand grenade according to claim 1, wherein the control part containing the ignition trigger, and the fuze, form a connected unit that is secured by a pin and is not connected to the active body until during preparation for use of the hand grenade, and that separation of the control part and the fuze situated in the active body is only possible after the pin has been pulled.

5. A hand grenade according to claim 4, wherein a curved safety piece, that is pre-tensioned by a spring and that is able to be secured by the pin, is arranged on the active body, and the fuze further includes a second switching element that interacts with the curved safety piece so that after removal of the pin and the control part, when the active body is thrown, the curved safety piece opens and the second switching element closes so that the receiving device is activated, the first ignition circuit is charged, and a first time-delay circuit is initiated.

6. A hand grenade according to claim 5, wherein the fuze further includes a compressed gas generator that, in the absence of the receipt of a coded ignition signal within a period of time that can be determined by a second time-delay circuit, is activated by a second ignition circuit so that the gas pressure produced is sufficient to expel the fuze from the active body.

7. A hand grenade according to claim 6, wherein the second ignition circuit is likewise activated by the second switching element.

8. A hand grenade according to claim 5, wherein the control part is connected to the fuze via a force-closed connection, or via a positive-engagement connection, or via a force-closed connection and a positive-engagement connection, so that even when the pin has been pulled, the curved safety piece cannot be swiveled into a released position, and release of the curved safety piece is only possible when the control part is removed from the fuze.

9. A hand grenade according to claim 1, wherein a safety element is arranged in the control part, wherein the safety element secures the ignition trigger element in a starting position until the control part is detached from the fuze.

10. A hand grenade according to claim 9, wherein the ignition device further includes a first switching element that at detachment of the control part from the active body activates a power supply unit for operating components of the ignition device.

11. A hand grenade according to claim 10, wherein the control part containing the ignition trigger, and the fuze, form a connected unit that is secured by a pin and is not connected to the active body until during preparation for use of the hand grenade, and that separation of the control part and the fuze situated in the active body is only possible after the pin has been pulled.

12. A hand grenade according to claim 9, wherein a curved safety piece, that is pre-tensioned by a spring and that is able to be secured by the pin, is arranged on the active body, and the fuze further includes a second switching element that interacts with the curved safety piece so that after removal of the pin and the control part, when the active body is thrown, the curved safety piece opens and the second switching element closes so that the receiving device is activated, the first ignition circuit is charged, and a first time-delay circuit is initiated.

13. A hand grenade according to claim 1, wherein the control part is a head part of the hand grenade that is connectable to the fuze via a screw connection.

14. A hand grenade according to claim 1, wherein the carrier signals for transmitting the ignition code are high-frequency signals, light signals, or sound signals.

15. A hand grenade according to claim 14, wherein the control part containing the ignition trigger, and the fuze, form a connected unit that is secured by a pin and is not connected to the active body until during preparation for use of the hand grenade, and that separation of the control part and the fuze situated in the active body is only possible after the pin has been pulled.

16. A hand grenade according to claim 1, wherein the fuze further includes a compressed gas generator that, in the absence of the receipt of a coded ignition signal within a period of time that can be determined by a second time-delay circuit, is by a second ignition circuit so that the gas pressure produced is sufficient to expel the fuze from the active body.

* * * * *